United States Patent [19]

Danieli

[11] Patent Number: 4,756,128

[45] Date of Patent: Jul. 12, 1988

[54] BEACH ANCHOR

[76] Inventor: Edmund R. Danieli, 380 Yolanda Ave., Santa Rosa, Calif. 95404

[21] Appl. No.: 79,571

[22] Filed: Jul. 30, 1987

[51] Int. Cl.[4] ..... E02D 5/80; E04H 15/62

[52] U.S. Cl. ..... 52/156; 52/166; 135/118

[58] Field of Search ..... 135/118; 52/155, 166, 52/156, DIG. 11, 4; 119/121; 114/293, 294, 295; 248/500,507, 508

[56] References Cited

U.S. PATENT DOCUMENTS

| | | | |
|---|---|---|---|
| 1,601,682 | 9/1926 | Curd | 52/166 |
| 3,534,751 | 10/1970 | Peters | 135/118 |
| 3,703,160 | 11/1972 | Biddle | 119/121 |
| 3,788,335 | 1/1974 | Hemmelsbach | 135/118 |
| 3,812,616 | 5/1974 | Koziol | 135/118 X |
| 4,000,585 | 1/1977 | Denaro | 135/118 X |
| 4,070,834 | 1/1978 | Jameson | 52/166 |
| 4,077,418 | 3/1978 | Cohen | 135/118 X |
| 4,263,925 | 4/1981 | Arganbright | 135/118 |
| 4,533,112 | 8/1985 | Santos et al. | 135/118 X |

*Primary Examiner*—J. Karl Bell
*Attorney, Agent, or Firm*—Henry H. Johnson

[57] ABSTRACT

An anchor that is inserted into the soil on a beach to keep the stern of the boat near the shore when the bow is anchored in the water. The anchor has a rod with a handle on one end and a point on the other. A flat strip has two parallel right angle bends in the same direction that divide the strip into three parts. The end of the first part is narrow and centered on the strip. The second part, between the two bends, forms a platform that can be stepped on, even with bare feet, to insert the anchor into light soil. The third part, between the second bend and the second end, is parallel to the first part and with the first part provides high resistance to the pull of a rope perpendicular to the plane of the first part. The flat strip has a hole large enough and located so the rod can be placed through the hole with the point past the narrow end of and against the first part of the flat strip with the bend of the handle pointed away from the second end of the flat strip. The rod is firmly attached to the first part of the flat plate.

13 Claims, 2 Drawing Sheets

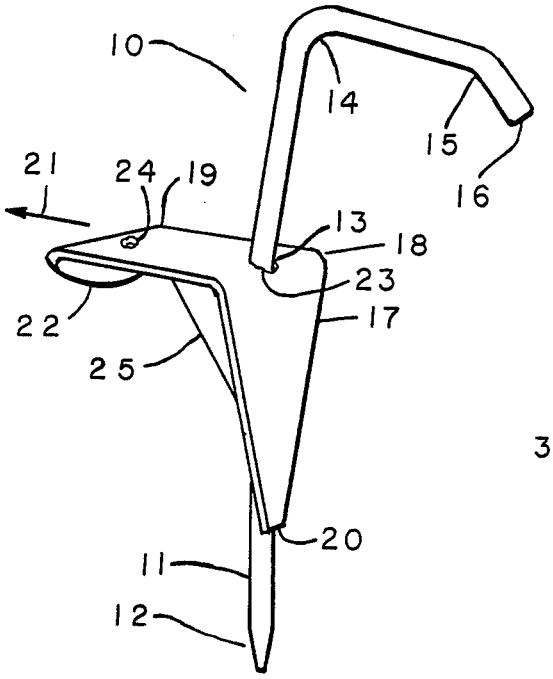
FIG. 1
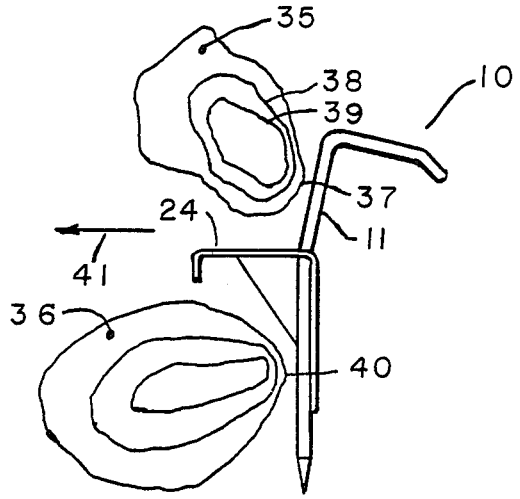
FIG. 2
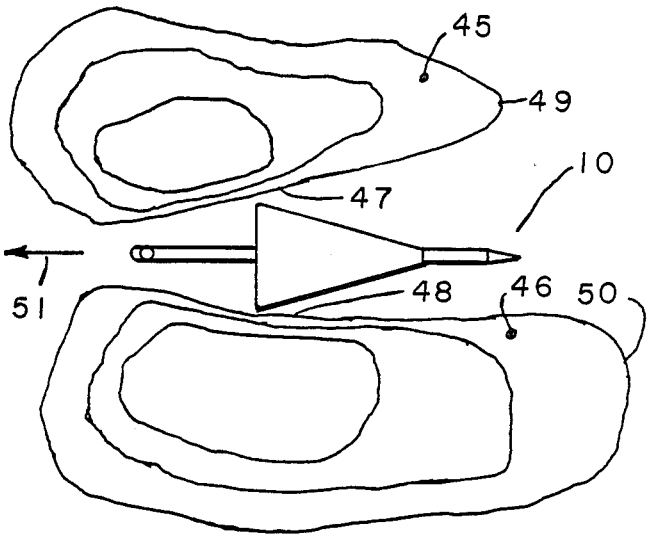
FIG. 3
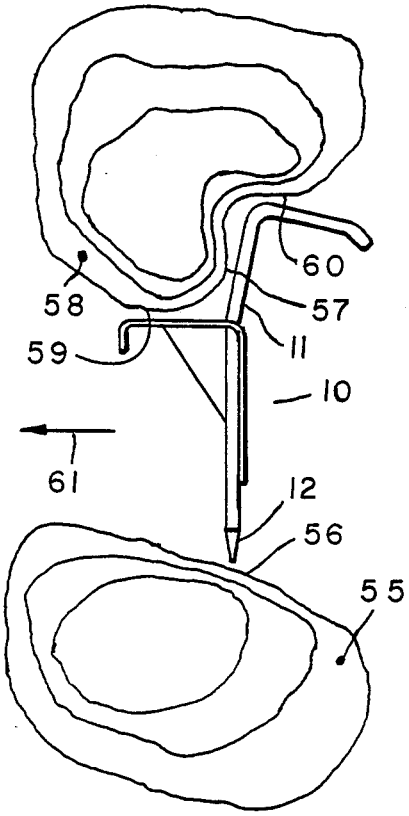
FIG. 4
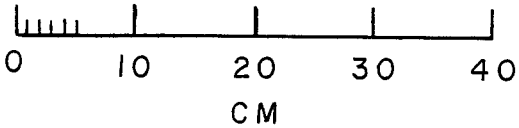

BEACH ANCHOR

FIELD OF THE INVENTION

This invention relates generally to an anchor which can be easily inserted into the soil of, or wedged between the rocks on a beach, to hold the stern of a boat near the shore when the boat is anchored in a stream or lake. U.S. Class 119/121 has a pet tender and U.S. Class 135/118 has a tent stake, both have some similiarity to the beach anchor.

BACKGROUND ART

When a boat is anchored in a stream, or lake, it is often very desirable to keep the boat from drifting away from shore due to currents and/or winds, to give more room to water skiers and other boats and to stay away from the larger waves further from shore. Under most conditions a 2 kg pull will keep the stern of a boat near shore.

Prior Art of the stake type have little surface near the soil level, to resist the pull of a rope on a sandy beach. The stake type has very little or no platform to step on for easy insertion. The Pet Tender, U.S. Pat. No. 3,703,160 of Biddle does have a foot step, but it is made of a rod too small to be used for bare feet and has part of the handle where it could hurt the instep of a foot if the anchor slipped during insertion into the soil. An auger type of anchor called "beach anchor" has been seen. It was about 40 cm long, was slow to screw into the soil, yet did not present a large surface perpendicular to the direction of pull near the soil level.

SUMMARY OF THE INVENTION

The beach anchor for boats has four main parts, three parts of a flat strip separated by a first and a second right angle bend and a fourth part, a rod. When in use, the first part of the flat strip, has the width of the rod diameter and is centered and widens to full strip width near the first bend and is vertical. The tapered narrow first part makes insertion into the soil easy and the wide portion at the top provides resistance to pull. The second part is the horizontal portion between the first and second bend and provides a platform that is readily accessible and makes it easy and quick to insert the anchor into soil even with bare feet. The third part of the flat strip is rounded for easy entry into soil. It is parallel to, and adds to, the resistance to pull along one axis perpendicular to the plane of the first part. The second bend reduces the sharpness of the platform end and the chance for injury should a bare foot slip off the platform. The fourth part, the rod, is placed through a hole in the platform and lies against, and is attached to, the first part of the strip. The pointed end extends past the end of the first part of the strip. The other end of the rod above the platform is bent away from the platform to form a handle. The handle is convenient to hold the anchor when stepping on the platform to insert the anchor into beach soil. It has no part above the platform that could injure the instep in case the foot slips off the platform. In heavier soils and soils with rocks, the anchor can be pounded in using small rocks to hit the platform. The platform can be supported with a gusset fastened to the bottom of the platform and the rod below the platform, in one embodiment, and bythe rod bent under the platform in other embodiments. In very rocky beaches, the anchor can be wedged between rocks and can be tied through a hole in the flat strip.

DESCRIPTION OF THE DRAWINGS

FIG. 1 is a perspective view of the preferred embodiment of the beach anchor.

FIG. 2 is a top view of the anchor held by two rocks with contour lines. The scale shown is for FIGS. 2, 3 and 4.

FIG. 3 is a top view of the anchor wedged between two rocks quite close together.

FIG. 4 is a top view of the anchor wedged between two rocks farther apart.

DESCRIPTION OF THE PREFERRED EMBODIMENTS

Figure 5:
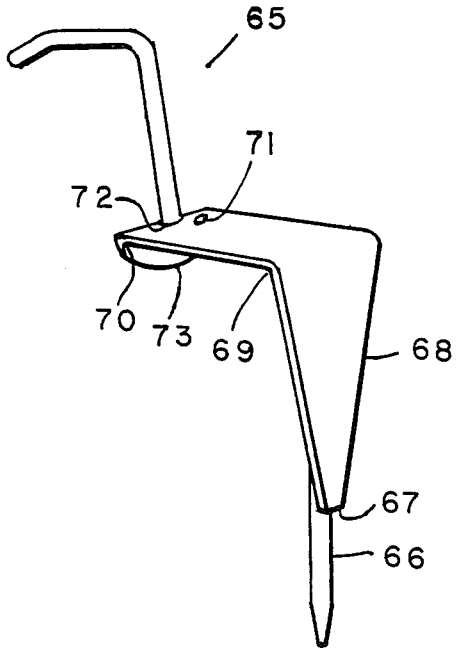
FIG. 5 is a perspective view of the second embodiment of the beach anchor.

In FIG. 1, the numeral 10 indicates the beach anchor with a rod 11, of annealed and cold drawn wire of 304 stainless steel, with a nominal diameter of 0.953 cm and a length of 41 cm. Rod 11, with all measurements from the first end, has a point 12, 0.3 cm in diameter, tapered for 3 cm; and three clockwise bends, the first 13; 12 degrees at 20.5 cm, the second 14; 90 degrees at 29.7 cm, and the third 15; 35 degrees at 39 cm. The handle end 16 should be deburred. Handle bends 13 and 14 provide foot clearance above the platform as can be best seen in FIG. 2.

Strip 17 is made from sheet stainless steel, type 304, cold rolled, annealed, pickled with a 2B finish, in 12 gauge, 0.267 cm nominal thickness into a flat strip 9 cm wide by about 25 cm long and is divided into three parts by a first 18, and a second 19, right angle, counterclockwise bend with a 0.5 cm inside radius. The tapered first part of the strip 17 has the narrow first end 20, 1 cm wide and centered, that goes to the 9 cm width, and with all distances measured from the first end 20, at 13 cm; a first bend 18 at 13.2 cm; a first hole 23, 1.2 cm in diameter at 13.7 cm; a 4.5 cm radius point for the second end at 20.8 cm; a second hole 24, 1.2 cm in diameter at 21.4 cm; a second bend 19, at 23 cm and the second end 22 at about 25.5 cm. When the anchor is fully inserted into soil, the first part; a tapered vertical surface from the first bend 18 to the first end 20, permits easy entry into the soil and provides a broad surface just below soil level to resist pull along the axis designated by arrow 21, a second part; a horizontal platform between the first 18 and second 19 bends, is used to step on, a third part; from the second bend 19 to the second end 22, has a radius of 4.5 cm for easy entry into the soil and adds to the resistance to pull of the first part. Rod 11 is welded to, and flat against, the first part and goes through hole 23, with point 12 7 cm past the first end 20 and with the handle end 16 pointing away from second end 22. A right triangular gusset 25, of the same material as the flat strip, is welded to the bottom of the platform and to the side of rod 11 to support the platform.

On shores on which the soil is too shallow or too rocky to get the anchor into, the anchor can often be used with rocks as shown in FIGS. 2, 3 and 4. Both rocks might be in a suitable position or one or both might be moved to make a suitable position.

FIGS. 2, 3 and 4 are drawn to the scale shown. In FIG. 2, the anchor 10 can often be put behind two rocks 35 and 36. The rope can be tied through hole 24 in the platform or around rod 11 above the platform then around the gusset 25. The numeral 37 points to the outside of the rock at ground level, 38 points to a contour line 5 cm above the ground level and 39 points to the contour line 5 cm above contour line 38. Rock 35 at point 37 and rock 36 at point 40 would be too steep, about 2 cm horizontally for 10 cm vertically, so rod 11 of anchor 10 would not slip up on rocks 35 and 36 with the rope pull in the direction of arrow 41.

In FIG. 3, anchor 10 is shown wedged between two rocks, 45 and 46 which have steep angled surfaces 47 and 48 respectively. A rope would likely slip off the leading edges 49 and 50 of rocks 45 and 46 respectively because the slope is about 5 cm vertical for every 10 cm horizontal. The rope pull is in the direction of arrow 51.

As shown in FIG. 4, the anchor 10 can have one rock 55 hold point 12 at the contact point near 56 and then hold the rod 11 near 57 of rock 58 and then hold either the platform at 59 or the handle at 60. The rope pulls in the direction of arrow 61.

A second embodiment, anchor 65, in FIG. 5 has a flat strip 68, with a first part from narrow end 67 to first bend 69; a platform from 69 to second bend 70 and a third part from 70 to second end 73. The first part and the platform is quite flat against, and welded to, rod 66 with the rod coming through a hole that includes part of the second bend. The hole is centered in strip 68. As an alternative, the rod can go about 1 cm under the platform, then go through, and be welded around, a hole in the third part, then go up as a handle. The rod either supports the platform by welding to the platform or by supporting the third part. Hole 71 for the rope can be put in the platform to one side of rod 11 and near second bend 70.

Figure 6:
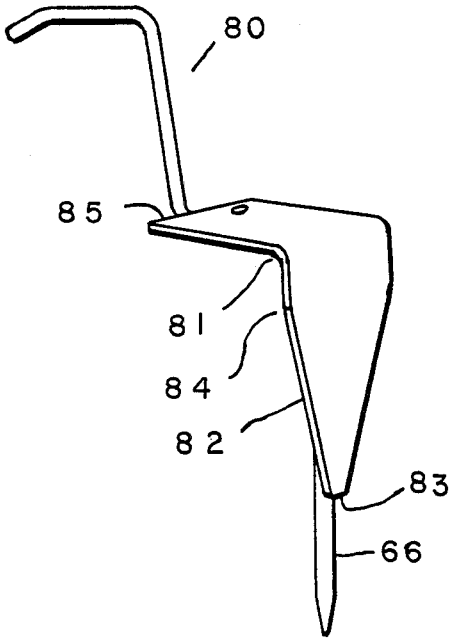
FIG. 6 is a perspective view of a variation of the second embodiment.

Anchor 80 in FIG. 6, shows another embodiment in which rod 66 is the same as in FIG. 5. In FIG. 6, a single right angle bend 81 divides strip 82 into a first part with a narrow first end 83, that becomes wider to 84 and has a full width strip from 84 to the right angle bend 81; and a second part, the platform, from the right angle bend 81 to the second end 85. The second end 85 can have corners with a radius of 0.5 cm and extends to the handle but can be notched out to let 85 extend further. The first part and platform are close enough to the rod to be readily welded to it.

All anchors should be deburred. None of the anchors have moving parts so they will not rattle and will cost less to manufacture.

While in the description specific dimensions have been given, one skilled in the art should be able to:

First, make the size of, and locate, hole 23, FIG. 1, so rod 11 can go through hole 23 and be readily welded to the first part of strip 17.

Second, change the proportions of any anchor to accommodate specific conditions, for example, for use in very sandy soils, the point 84, FIG. 6, could be moved to increase the area, and holding power between 81 and 84.

Third, make a lower cost model using other materials and processes; for example, an anchor of mild, low carbon steel, deburred, welded and then plated or painted; rather than the durable good looking, rust proof anchor using the gauge and width of the strip, the rod diameter, the material and manufacturing procedure as given for anchor 10, FIG. 1.

Also within the scope of my invention is another embodiment similar to the anchor 10, in FIG. 1, but with rod 11 on the other side of the first part. There would be no hole 23, gusset 25 would be a little larger with the right angle corner cut back enough so the gusset would fit, and be readily welded to, the bottom of the platform and the platform side of the first part.

I claim:

1. A beach anchor comprising:

a rod, having a pointed end to be inserted down into soil and the other end formed into a handle; and a flat strip, divided into three parts by a first right angle bend between the first part and the first end of the platform and a second right angle bend between the second end of the platform and the third part; with the first part, having a wide end and a narrow end, attached to the rod, with the narrow end above the pointed end of the rod and the wide end attached to the first end of the platform; with means to support the platform; with the handle higher than, and at one end of, the platform.

2. A beach anchor as in claim 1:

with, at one end of, the platform—being the first end of the platform.

3. A beach anchor as in claim 1:

with, one end of, the platform—being the second end of the platform.

4. A beach anchor as in claim 1, further comprising:

with, the flat strip having a hole for a rope near the second end of the platform.

5. A beach anchor as in claim 1:

with, the second end of the flat strip made so it will enter the soil easier.

6. A beach anchor as in claim 1:

with the rod going through a hole in the flat strip having a diameter and location that permits the rod to go through the strip near the first bend and lie against the platform side of first part.

7. A beach anchor as in claim 2:

with, the handle higher than the platform—having two bends that provide foot clearance above the platform.

8. A beach anchor as in claim 3:

with, means to support the platform—being the rod attached to the bottom of the platform.

9. A beach anchor as in claim 3:

with, means to support the platform—being the rod attached to the third part, having a hole, with the rod going through, and attached around, the hole of the third part.

10. A beach anchor comprising:

a rod, having a pointed end to be inserted into soil, and having the other end formed into a handle; and a flat strip, having a first part and a platform divided by a right angle bend; and with the first part, having a wide end and a narrow end, attached to the rod, with the narrow end above the pointed end of the rod and the wide end attached to one end of the platform at the right angle bend; and means to support the platform.

11. A beach anchor as in claim 10, further comprising:

a gusset; with means to support the platform—being a gusset attached to the bottom of the platform and the rod.

12. A beach anchor as in claim 10;

with the first part attached to the rod—on the side of the first part opposite the platform.

13. A beach anchor as in claim 12, further comprising:

a gusset; with means to support the platform—having the gusset attached to the bottom of the platform and to the platform side of the first part.

* * * * *